US008529004B2

(12) United States Patent
Hayashi et al.

(10) Patent No.: US 8,529,004 B2
(45) Date of Patent: Sep. 10, 2013

(54) PRINTING APPARATUS AND PRINTING METHOD

(75) Inventors: Masaki Hayashi, Suwa (JP); Nobuhiro Karito, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 539 days.

(21) Appl. No.: 12/621,715

(22) Filed: Nov. 19, 2009

(65) Prior Publication Data

US 2010/0123750 A1 May 20, 2010

(30) Foreign Application Priority Data

Nov. 19, 2008 (JP) ..... 2008-296026

(51) Int. Cl.
*B41J 29/38* (2006.01)

(52) U.S. Cl.
USPC ..... 347/14

(58) Field of Classification Search
USPC ..... 347/14
See application file for complete search history.

(56) References Cited

U.S. PATENT DOCUMENTS

| | | | | |
|---|---|---|---|---|
| 6,390,598 | B2 | 5/2002 | Sato et al. | |
| 2005/0206668 | A1* | 9/2005 | Yoshida | 347/12 |
| 2006/0279596 | A1* | 12/2006 | Furuichi et al. | 347/15 |

FOREIGN PATENT DOCUMENTS

| | | | |
|---|---|---|---|
| JP | 2002-011859 | A | 1/2002 |
| JP | 2005-205849 | A | 8/2005 |
| JP | 2006-205616 | A | 8/2006 |
| JP | 2008-149566 | A | 7/2008 |

* cited by examiner

*Primary Examiner* — Uyen Chau N Le
*Assistant Examiner* — Hoang Tran
(74) *Attorney, Agent, or Firm* — Kilpatrick Townsend & Stockton LLP

(57) ABSTRACT

A printing apparatus includes a print head that has a plurality of nozzles including lower-end portion nozzles, center-portion nozzles, and upper-end portion nozzles, a medium transport unit that transports a medium that becomes a printing target, an edge detecting unit that detects an edge included in image data, and a print control unit that forms a pixel pattern on the medium by driving the print head together with relatively moving the print head and the medium that becomes the printing target, forms an overlapping pixel pattern on the medium by using nozzles, the number of which is a first number in a case where the edge is not detected by the edge detecting unit for the overlapping pixel pattern that can be formed by the upper-end portion nozzle and the lower-portion nozzle, and forms the overlapping pixel pattern on the medium by using nozzles, the number of which is a second number smaller than the first number in a case where the edge is detected by the edge detecting unit.

14 Claims, 14 Drawing Sheets

FIG. 16

DOT PATTERN TO BE FORMED ●●●●●●

| NOZZLE NUMBER | RASTERIZATION CONTROL DATA (OVERLAP) |
|---|---|
| 0 | 1 0 1 0 1 0 |
| 3 | 1 1 1 1 1 1 |
| 6 | 0 1 0 1 0 1 |

FIG. 17

DOT PATTERN TO BE FORMED ●●●●●●

| NOZZLE NUMBER | RASTERIZATION CONTROL DATA (OVERLAP RELEASED) |
|---|---|
| 0 | 0 0 0 0 0 0 |
| 3 | 1 1 1 1 1 1 |
| 6 | 1 1 1 1 1 1 |

PRINTING APPARATUS AND PRINTING METHOD

This application claims priority to Japanese Patent Application No. 2008-296026, filed Nov. 19, 2008, the entirety of which is incorporated by reference herein.

BACKGROUND

1. Technical Field

The present invention relates to a printing control device and a printing apparatus that control formation of a pixel pattern on a medium.

2. Related Art

As printing apparatuses, ink jet printers that form a pixel pattern on a medium by ejecting ink droplets from a print head having a plurality of nozzles have been widely known. There are individual differences among the nozzles included in the print head, and accordingly, there are mismatches in the amounts of ejection, timings, and the like among the nozzles. In addition, there is a variation in the number of transports due to slippage or the like in a paper transporting process. Therefore, there are mismatches in the landing positions of dots from the nozzles. Thus, in the ink jet printers, in order to suppress or resolve joints (banding) that are generated between print widths (bands) formed by scanning of the print head each time, technology in which a lower-end portion nozzle and an upper-end portion nozzle are used for print in an overlapping manner between the bands has been proposed (for example, JP-A-2002-11859). In this printing technology, a variation in the pixel forming positions is reduced by increasing the number of nozzles that are used for a printing process, in which the lower-end portion nozzle and the upper-end portion nozzle are used in an overlapping manner, to be larger than the number of nozzles that are used for a printing process in which the lower-end portion nozzle and the upper-end portion nozzle are not used in an overlapping manner.

However, when a part of the nozzle rows are used for printing in an overlapping manner for suppressing the banding, there is a problem in that the reproducibility of the edge included in an image is lowered. In other words, the pixel forming positions are dispersed, and accordingly, there is a problem that unsteady edges are generated.

In addition, such a problem is not limited to a printing apparatus that forms a dot pattern by moving the print head in the main scanning direction and moving the medium in the sub-scanning direction, and the problem occurs commonly in a line-head-type printing apparatus that forms a dot pattern by arranging a plurality of nozzle rows in a linear pattern in the main scanning direction and moving the medium in the sub-scanning direction.

SUMMARY

An advantage of some aspects of the invention is that it provides a printing control device, a printing apparatus, and a printing control method capable of improving the reproducibility of the edge in a printing process.

The invention may have various forms as below.

According to a first aspect of the invention, there is provided a printing control device. The printing control device according to the first aspect includes: an edge detecting unit that detects an edge included in image data, a print head that has a plurality of nozzles including lower-end portion nozzles, center-portion nozzles, and upper-end portion nozzles; and, as a print control unit that forms a pixel pattern on the medium by driving the print head together with relatively moving the medium that becomes a printing target, a print control unit that forms an overlapping pixel pattern on the medium by using nozzles, the number of which is a first number, in a case where the edge is not detected by the edge detecting unit from the overlapping pixel pattern that can be formed by the upper-end portion nozzle and the lower-end portion nozzle and forms the overlapping pixel pattern on the medium by using nozzles, the number of which is a second number smaller than the first number in a case where the edge is detected by the edge detecting unit.

According to the above-described printing control device, for the overlapping pixel pattern that can be formed by the upper-end portion nozzle and the lower-end portion nozzle, the overlapping pixel pattern is formed on the medium by using nozzles, the number of which is the second number smaller than the first number, which is used in a case where the edge is not detected, in a case where the edge is detected by the edge detecting unit. Therefore, the reproducibility of the edge in the printing process can be improved.

In the above-described printing control device, the print control unit may be configured to form the pixel pattern on the medium by using the nozzles, the number of which is the second number for pixel patterns other than the overlapping pixel pattern. In such a case, a non-overlapping pixel pattern can be formed.

In the above-described printing control device, the print control unit may be configured to form the pixel pattern on the medium in a first scanning direction by relatively moving the print head and the medium in the first scanning direction and a second scanning direction that is perpendicular to the first scanning direction and forms the overlapping pixel pattern on the medium in the first scanning direction by using the nozzles, the number of which is the second number in a case where the detected edge is included in the overlapping pixel pattern. In such a case, the pixel pattern can be formed on the medium by relatively moving the print head and the medium in the first scanning direction and the second scanning direction perpendicular to the first scanning direction.

In the above-described printing control device, it may be configured that the edge detecting unit detects the edge forming pixel data, which forms an edge, out of the pixel data that constitutes the image data, and the print control unit forms the overlapping pixel pattern on the medium in the first scanning direction by using the nozzles, the number of which is the second number in a case where a pixel corresponding to the detected edge forming pixel data is included in the overlapping pixel pattern. In such a case, in a case where a pixel corresponding to the detected edge forming pixel data is included in the overlapping pixel pattern, the overlapping pixel pattern is formed on the medium in the first scanning direction by using nozzles, the number of which is the second number smaller than the first number. Accordingly, the reproducibility of the edge in the printing process can be improved.

In the above-described printing control device, the print control unit, as a data generating unit that generates the print data for forming the pixel pattern in the first scanning direction based on the image data, may be configured to include a print data generating unit that generates the print data for forming the overlapping pixel pattern by using nozzles, the number of which is the second number, as the print data of the overlapping pixel pattern including the pixel corresponding to the edge forming pixel data. In such a case, as the print data of the overlapping pixel pattern that includes the pixel corresponding to the edge forming pixel data, the print data for forming the overlapping pixel pattern can be generated by using nozzles, the number of which is the second number.

In the above-described printing control device, the print control unit may be configured to farm the pixel pattern on the medium by relatively moving the print head and the medium, which is performed by moving the print head in the first scanning direction and moving the medium in the second scanning direction. In such a case, the pixel pattern can be formed on the medium by moving the medium in the second scanning direction together with moving the print head in the first scanning direction.

In the above-described printing control device, the edge detecting unit may be configured to perform the edge detecting process in a case where the image data includes a document or line drawing. In such a case, the reproducibility of the edge in a text or a line can be improved in a printing process.

The above-described printing control device may further include: a text detecting unit that detects whether or not text is included in the target data; and an image converting unit that converts the target data into the image data, wherein the edge detecting unit performs the edge detecting process in a case where the image data is determined to include text by the text detecting unit. In such a case, the reproducibility of the edge can be improved while suppressing a decrease in the print control processing speed.

In the above-described printing control device, in a case where the medium is moved in the second scanning direction such that a pixel pattern that can be formed by the upper-end portion nozzle and a pixel pattern that can be formed by the lower-end portion nozzle are overlapped with each other, the print control unit may be configured to form the overlapping pixel pattern on the medium in the first scanning direction that is perpendicular to the second scanning direction by using nozzles, the number of which is the first number for a case where the edge is not detected from the overlapping pixel pattern by the edge detecting unit and form the overlapping pixel pattern on the medium in the first scanning direction by using nozzles, the number of which is the second number for a case where the edge is detected from the overlapping pixel pattern by the edge detecting unit.

In the above-described printing control device, the print control unit may be configured to form the pixel pattern on the medium in the first scanning direction by using either the lower-end portion nozzle or the upper-end portion nozzle that has characteristics closer to those of the center-portion nozzle in a case where the edge is detected by the edge detecting unit. In such a case, the reproducibility of the edge can be improved further.

In the above-described printing control device, the print control unit may be configured to form the pixel pattern on the medium by moving the medium such that a pixel pattern that can be formed by the upper-end portion nozzle and a pixel pattern that can be formed by the lower-end portion nozzle are overlapped with each other and move the medium such that the pixel pattern that can be formed by the upper-end portion nozzle and the pixel pattern that can be formed by the lower-end portion nozzle are not overlapped with each other in a case where the edge is detected from the overlapping pixel pattern by the edge detecting unit. In such a case, the reproducibility of the edge can be improved.

In the above-described printing control device, the print control unit may be configured to move the medium such that the pixel pattern that can be formed by the upper-end portion nozzle and the pixel pattern that can be formed by the lower-end portion nozzle are overlapped with each other in a case where the edge is not detected by the edge detecting unit and move the medium such that the pixel pattern that can be formed by the upper-end portion nozzle and the pixel pattern that can be formed by the lower-end portion nozzle are not overlapped with each other in a case where the edge is detected by the edge detecting unit. In a case where the edge is detected by the edge detecting unit, the medium is moved such that the pixel pattern that can be formed by the upper-end portion nozzle and the pixel pattern that can be formed by the lower-end portion nozzle are not overlapped with each other, and accordingly, the reproducibility of the edge can be improved.

According to a second aspect of the invention, there is provided a printing apparatus. The printing apparatus according to the second aspect includes: a print head that includes a plurality of nozzles including lower-end portion nozzles, center-portion nozzles, and upper-end portion nozzles; a medium transport unit that transports a medium that becomes a printing target; an edge detecting unit that detects an edge included in the image data, and, as a print process performing unit that forms a pixel pattern on the medium by relatively moving the print head and the medium by driving the print head and the medium transport unit, a print process performing unit that forms the pixel pattern on the medium by using nozzles, the number of which is a first number, out of the plurality of nozzles in a case where any edge is not detected by the edge detecting unit from the overlapping pixel pattern that can be formed by the upper-end portion nozzle and the lower-end portion nozzle and forms the pixel pattern on the medium by using nozzles, the number of which is the second number smaller than the first number in a case where the edge is detected by the edge detecting unit.

According to the printing apparatus of the second aspect, the same advantages as those of the printing control device of the first aspect can be acquired. In addition, the printing apparatus according to the second aspect can be implemented in various forms similarly to the printing control device according to the first aspect.

According to a third aspect of the invention, there is provided a printing control method. The printing control method according to the third aspect includes: detecting an edge that is included in the image data; and forming an overlapping pixel pattern on a medium by using nozzles out of a plurality of nozzles, which is configured to include a lower-end portion nozzle, a center-portion nozzle and an upper-end portion nozzle, included in the print head, the number of which is a first number in a case where any edge is not detected from the image data for an overlapping pixel pattern that can be formed by the upper-end portion nozzle and the lower-end portion nozzle and forming an overlapping pixel pattern on the medium by using nozzles, the number of which is a second number smaller than the first number in a case where an edge is detected from the image data.

According to the printing control method of the third aspect, the same advantages as those of the printing control device of the first aspect can be acquired. In addition, the printing control method according to the third aspect can be implemented in various forms similarly to the printing control device according to the first aspect. Furthermore, the printing control method of the third aspect can be implemented as a printing control program or a computer-readable medium storing a printing control program thereon.

BRIEF DESCRIPTION OF THE DRAWINGS

The invention will be described with reference to the accompanying drawings, wherein like numbers reference like elements.

FIG. 16 is an explanatory diagram showing an example of ON (1)/OFF (0) data for dot formation that is assigned to nozzles #0, #3, and #6 for forming an overlapping pixel row.

FIG. 17 is an explanatory diagram showing an example of ON (1)/OFF (0) data for dot formation that is assigned to nozzles #0, #3, and #6 for canceling overlapping for an overlapping pixel row.

DESCRIPTION OF EXEMPLARY EMBODIMENTS

Hereinafter, a printing control device and a printing apparatus according to embodiments of the invention will be described with reference to the accompanying drawings.

First Embodiment

Configuration of Printing Apparatus and Computer

Figure 1:
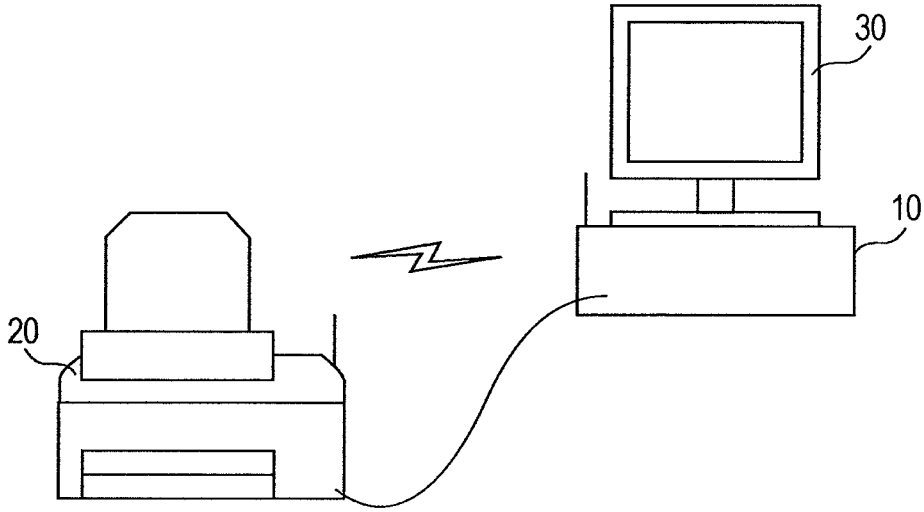
FIG. 1 is an explanatory diagram showing a computer and a printing apparatus according to a first embodiment of the invention.
Figure 2:
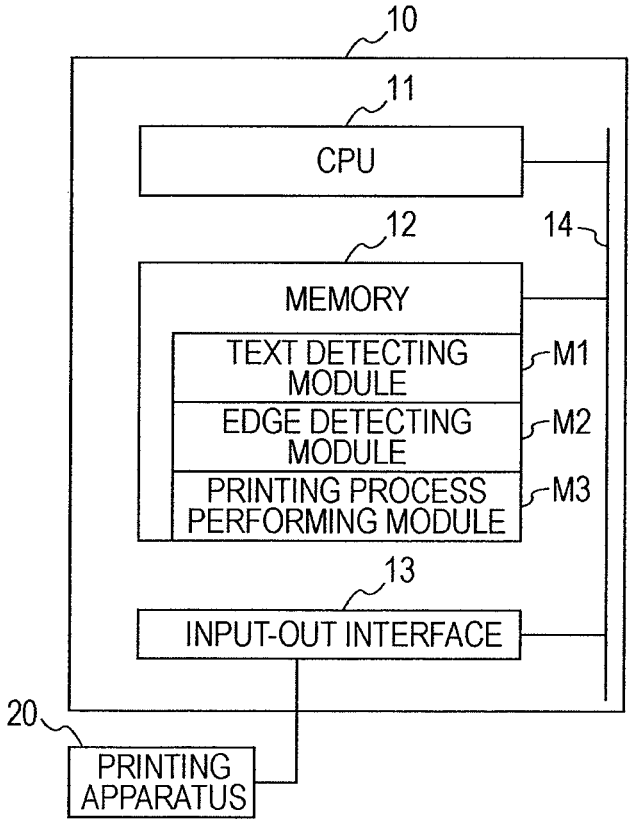
FIG. 2 is a functional block diagram showing the internal functional configuration of a computer according to this embodiment.
Figure 3:
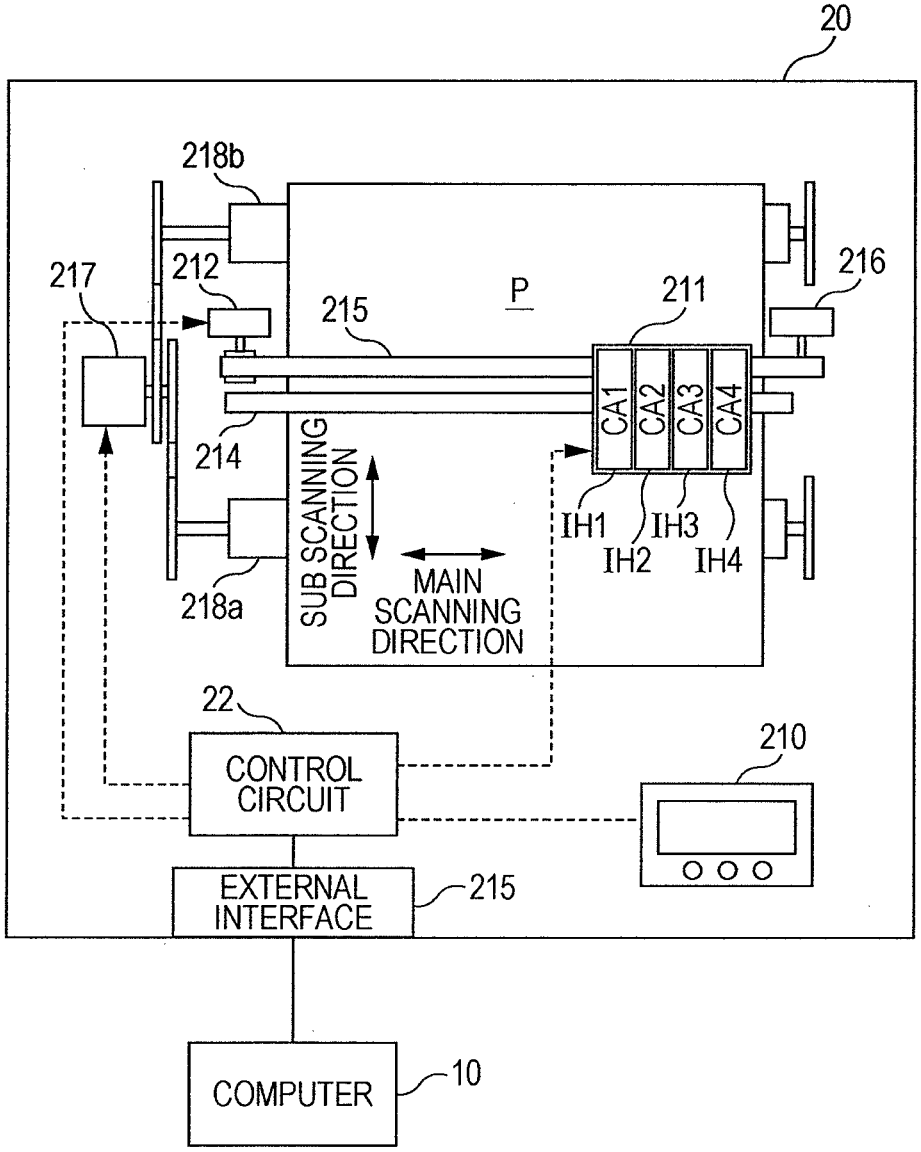
FIG. 3 is an explanatory diagram showing the internal configuration of a printing apparatus according to this embodiment.

A schematic configuration of a computer serving as a printing control device according to a first embodiment of the invention and a schematic configuration of a printing apparatus according to the first embodiment will now be described. FIG. 1 is an explanatory diagram showing the computer and the printing apparatus according to the first embodiment. FIG. 2 is a functional block diagram showing the internal functional configuration of the computer according to this embodiment. FIG. 3 is an explanatory diagram showing the internal configuration of the printing apparatus according to this embodiment.

A personal computer 10 and a printing apparatus 20 are locally connected to each other through a connection cable CV in a wired manner. The printing apparatus 20 and the personal computer 10 may be locally connected to each other in a wireless manner or be connected to each other through a network in a wired or wireless manner. In a form in which the printing apparatus 20 is connected to the personal computer 10 so as to be used, the personal computer 10 serves as the printing control device. The personal computer 10 that serves as a printing control device generates print data including a control command that can be analyzed by the printing apparatus 20 based on the data, which is directed to be printed, such as image data or text data and transmits the print data to the printing apparatus 20. In the control command, commands for controlling an operation of a carriage of the printing apparatus, an operation of transporting a paper sheet that is a printing medium, and an operation (ejection of ink) of a print head of the printing apparatus are included. The operation of the carriage and the paper transporting operation are changed in accordance with the required printing resolution. The printing control device is realized by executing a printer control program, that is, a so-called printer driver by using the personal computer 10.

To the personal computer 10, a display device 30 is connected. The personal computer 10 includes a central processing unit (CPU) 11, a memory 12, an input-output interface 13, and an internal bus 14. The CPU 11 implements various function units by executing various programs that are stored in the memory 12. The memory 12 is implemented by using a read only memory (ROM), a random access memory (RAM), and a hard disk drive (HDD). In this embodiment, the term "memory 12" is used for collectively referring to a non-volatile memory device in which the above-described various programs are stored and a volatile memory device that is used for executing various programs.

The memory 12 includes a text detecting module M1, a rasterization module M2, and an edge detecting module M3, and a print process performing module M4 for performing a print control process. By performing these modules M1 to M3 by using the CPU 11, a text detecting unit, an edge detecting unit, and a print control unit are realized. In this embodiment, the above-described modules are implemented in the software. However, the above-described modules may be implemented in the hardware devices that include logic circuits corresponding thereto.

The text detecting module M1 detects whether or not a text is included in the printing target data based on whether or not a text code is included in the printing target data. The text detecting module M1 can also specify a text area by referring to layout information that is included in the printing target data. In particular, the text detecting module M1 directly processes a data file for an application program in a case where information on the printing target data, that is, a text code and the layout information received from the application program can be directly analyzed. On the other hand, in a case where the printing target data that is generated by the application program is converted into intermediate data having a common data format by a function provided by the operating system (OS), the text detecting module M1 performs text detection based on the intermediate data. As the function provided by the OS, for example, there is an API function. In addition, the printing target data from which the text detecting module M1 can detect a text code is bit map (non image) data referred to as text data that maintains text information by using a so-called text code. The intermediate data may be configured to be directly received by the printer driver, that is, a print control processing program including the text detecting module M1, the rasterization module M2, the edge detecting module M3, and the print process performing model M4.

The rasterization module M2 expands the intermediate data that is output from the text detecting module M1 in the memory as image data, that is, rasterized data. Alternatively, the rasterization module M2 expands printing target data that is originally rasterized data and is not processed by the text detecting module M1 in the memory. In addition, the dots (pixels) that are formed by rasterization are managed in units of dots corresponding to a dot pattern (one row formed in the main scanning direction) formed in the main scanning direction as a rasterized data piece. When one rasterized data piece corresponds to a position in which a text is detected by the text detecting module M1, a text detection flag is recorded in a header of the rasterized data piece. In other words, the text detection flag is a flag indicating that a dot constituting a text is included in each rasterized data piece. Here, the header may not be included for each rasterized data piece. For example, a header in which coordination information of pixels and text flags for all the rasterized data pieces are stored so as to be associated with each other may be included.

The edge detecting module M3 detects an edge included in the printing target data that has been rasterized (or that is originally rasterized). The edge detecting process is performed only for the rasterized data piece, which is associated with the above-described text flag, out of the printing target data that has been rasterized by the rasterization module M2.

In this embodiment, a pixel having the K component value of 100% (for example, a pixel having the K component value of "255" for the case of 8 bit gray scale) is determined to be an edge forming pixel by using the image data that has been converted in color from RGB data into CMYK data by the print process performing module M4 to be described later. The threshold values used for detecting an edge may be a different value "250" or "230". Alternatively, for example, in a case where a difference value between K components of adjacent pixels is equal to or larger than a determination value 250 or 220, a pixel having a larger K component value may be determined to be an edge forming pixel. In such a case, only pixels that form contour portions of a text can be determined as the edge foaming pixels. In addition, the K component value may be configured to be 100% for the case of "255" or be 100% for the case of "0".

The print process performing module M4 generates the rasterization control data that is used for forming a dot pattern corresponding to the printing target data by performing a half-tone process for the CMYK data that is converted in color from RGB data rasterized by the rasterization module M2. In particular, the print process performing module M4 converts the CMYK data that is multiple-valued data into binary rasterization control data represented in binary values by using a dither matrix or an error diffusion method. The acquired rasterization control data is data that is associated with each of a plurality of nozzles included in the nozzle row arranged for ink of each color of CMYK and controls ON/OFF of ink ejection. In other words, by driving each nozzle of the print head based on the rasterization control data, a dot pattern representing an image that is represented by the printing target data is formed on a paper sheet used as a medium.

The input-output interface 13 is a physical and software port that interconnects the printing apparatus 20 and the personal computer 10. In a case where the printing apparatus 20 and the personal computer 10 are interconnected by wireless communication, the input-output interface 13 includes a function for controlling antennas and the transmission and reception of signals.

The internal bus 14 interconnects the CPU 11, the memory 12, and the input-out interface 13 for two-way communication.

Hereinafter, the internal configuration of the printing apparatus 20 will be described in detail with reference to FIG. 3. The printing apparatus 20 includes a printing mechanism 21 and a control circuit 22. The printing apparatus 20, for example, may be an ink jet printer only having a printing function or a multifunction-type ink jet printer including a document reading device (document reading function) for reading a document.

As the printing mechanism 21, a main-scanning transport mechanism, a sub-scanning transport mechanism, and a print head driving mechanism are included. The control circuit 22 performs a printing process that forms a dot pattern on a paper sheet used as a printing medium by controlling the operations of the above-described mechanisms based on the print data that is received from the personal computer 10.

The printing mechanism 21 will now be described. The main-scanning transport mechanism includes a carriage motor 212 that drives a carriage 211 as a movable body, a slide shaft 214 that is installed to be parallel to the axis of the platen 213 and holds the carriage 211 to be slidable, a pulley 216 in which an endless driving belt 215 is installed from the carriage motor 212, and a position sensor (not shown) that detects the origin position of the carriage 211. The main-scanning transport mechanism reciprocates the carriage 211 in the axis direction (main scanning direction) of the platen 213 by using the carriage motor 212. The amount of movement of the carriage 211 can be detected by a position detecting sensor such as an encoder. In this embodiment, the main scanning direction is the axial direction of the platen 213, that is, the direction of movement of the carriage 211.

The carriage 211 is a movable body that includes one, two, or more print heads IH, not shown in the figure, positioned on a face facing the paper sheet P as a printing medium. The print head IH is included for each ink type, and a plurality of nozzles for ink ejection is included in each print head IH. The carriage 211 moves to a home position when a printing operation is not being performed.

The printing apparatus 20 that is used in this embodiment is a so-called on-carriage-type printing apparatus in which an ink cartridge serving as an ink supplying source is mounted on the carriage 211. However, the invention may be applied to an off-carriage-type printing apparatus in which the ink cartridge is installed on a holder separated from the carriage 211 in the same manner. In this embodiment, each of the four ink cartridges, for example, ink cartridges CA1 to CA4 that house ink of four colors including black, yellow, magenta, and cyan are installed on a holder (not shown) located on the carriage 211. To the print heads IH1 to IH4, ink stored in the ink cartridges CA1 to CA4 is supplied through an ink supplying system not shown in the figure.

The sub-scanning transport mechanism includes a paper transport motor 217, a first paper transport roller 218*a*, and a second paper transport roller 218*b*. The sub-scanning transport mechanism transports the paper sheet P in the sub-scanning direction by transferring the rotation of the paper transport motor 217 to the transport rollers 218*a* and 218*b* through gear trains. In this embodiment, the sub-scanning direction is a direction perpendicular to the main scanning direction and is also the direction of movement of the paper sheet.

The head driving mechanism forms a desired dot pattern on a paper sheet P by driving the print head mounted on the carriage 211 and controlling the amounts and time intervals of ink ejection. For example, as the head driving mechanism, either a driving mechanism that utilizes the transformation of a piezo element that is transformed in accordance with the application of a voltage or a driving mechanism that utilizes air bubbles generated inside the ink by using a heater that dissipates heat in accordance with the application of a voltage is used.

The control circuit 22 is connected to the carriage motor 212, the paper transport motor 217, an operation panel 219, and the print heads IH1 to IH4 (actuators) through signal lines. The operation panel 219 includes operation buttons that are used for inputting a user's direction and a display unit that displays the contents of the operation. The control circuit 22 drives the carriage motor 212, the paper transport motor 217, and the print heads IH1 to IH4 (actuators) based on a direction from a personal computer connected thereto or the operation panel 219 or various programs stored in the control circuit 22. In addition, the control circuit 22 may include an external input-output terminal 210 so as to be connected to an external device such as a computer or a digital still camera through the external input-output terminal 210, or may include a memory card slot so as to be connected to an external memory device.

Configuration of Print Head

Figure 4A:
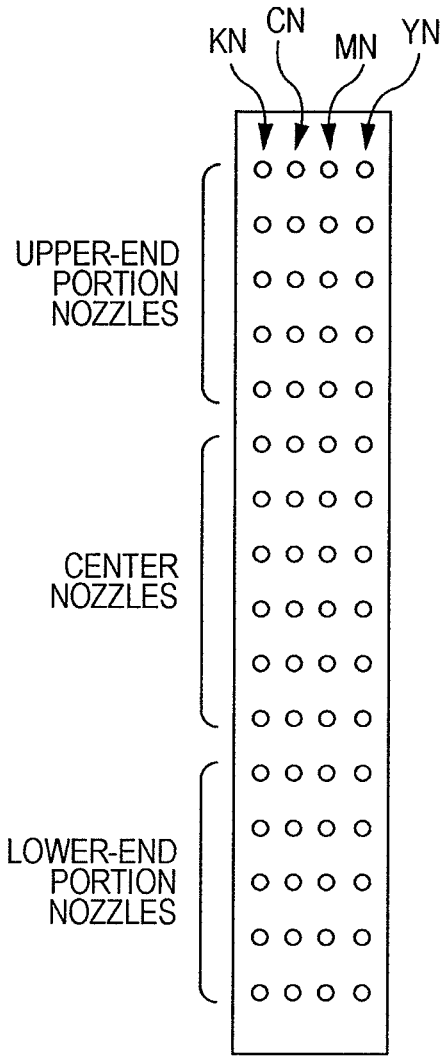
FIGS. 4A and 4B are explanatory diagrams schematically showing examples of the nozzle arrangements of print heads that are used in this embodiment.
Figure 4B:
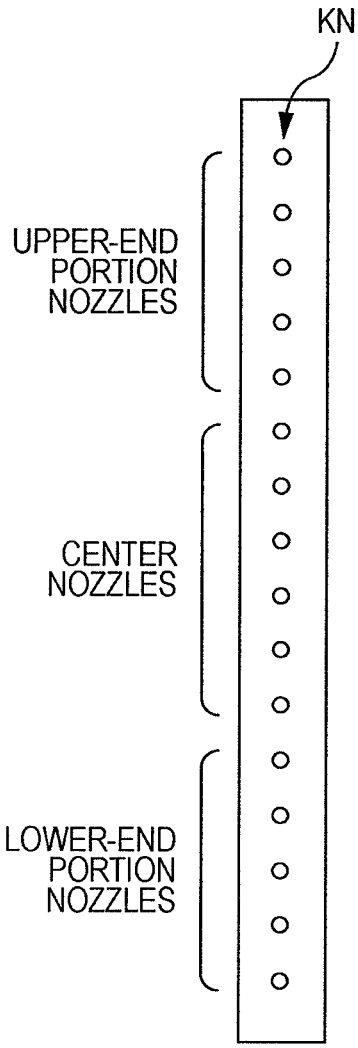

The configuration of the print head will now be described briefly. FIGS. 4A and 4B are explanatory diagrams schematically showing examples of the nozzle arrangements of the print heads that are used in this embodiment. FIG. 4A shows the nozzle arrangement of a print head on which ink cartridges of a plurality of colors are mounted, and FIG. 4B shows the nozzle arrangement of a print head on which an ink cartridge of one color is mounted. The nozzle rows of colors may be disposed in an alternated zigzag pattern, or a plurality of nozzle rows of the same color may be disposed.

In the example shown in FIG. 4A, nozzle rows CN, MN, YN, and KN for CMYK colors are provided. Each of the nozzle rows CN, MN, YN, and KN is configured by a plurality of nozzles. The plurality of nozzles of each of the nozzle rows CN, MN, YN, and KN can be divided into upper-end portion nozzles, center nozzles, and lower-end portion nozzles. In the example shown in FIG. 4B, a nozzle row KN for one color of K is provided. The nozzle row KN is constituted by a plurality of nozzles and can be divided into upper-end portion nozzles, center nozzles, and lower-end portion nozzles. In this embodiment, for simplification of description, a single nozzle row will be described as below, as an example.

Here, the upper-end portion nozzles and the lower-end portion nozzles are nozzles (nozzle group) having different positions in the sub-scanning direction that are located in a same nozzle row that can form one straight-line pixel pattern in the main scanning direction. In other words, the upper-end portion nozzles and the lower-end portion nozzles are nozzles (nozzle group) that are used for performing so-called overlapping print. Generally, when a printing operation exceeding the width (band) of the print head is performed, the dot forming nozzle is switched from the lower-end nozzle to the upper-end nozzle. However, the characteristics of each nozzle are not adjusted in consideration of dot formation by using the lower-end nozzle and dot formation by using the upper-end nozzle which belong to different passes. As a result, when the dot forming nozzle is switched from the lower-end nozzle to the upper-end nozzle, there are cases where distribution of dots is not appropriate, compared to a case where the dot forming nozzle is switched between other nozzles. In addition, in a case where the dot pattern is formed in units of bands of the print head, that is, in a case where the dot pattern corresponding to the width of the print head is formed by scanning once, the paper sheet is transported in the sub-scanning direction each time the scanning is performed. Accordingly, a gap between the lower-end nozzle and the upper-end nozzle is not necessarily determined mechanically, and banding can easily occur. Therefore, overlapping print, in which the transport amount in the sub-scanning direction is adjusted such that the lower-end nozzle and the upper-end nozzle perform scanning in an overlapping manner, has been performed. Described in more detail, the printing medium is transported such that one straight-line pixel pattern aligned in the main scanning direction and is formed by a plurality of nozzles, which are in a same nozzle row, having different positions in the sub-scanning direction. In this embodiment, a pixel pattern to be formed by performing overlapping print is referred to as an overlapping pixel pattern. On the other hand, a pixel pattern that is to be formed by performing overlapping print but is formed by canceling the overlapping print is referred to as an overlapping-cancelled pixel pattern. In addition, a pixel pattern that is formed by performing non-overlapping print is referred to as a non-overlapping pixel pattern. The overlapping pixel pattern is a pixel pattern that can be formed by the upper-end portion nozzles and the lower-end nozzles. Described in more detail, the overlapping pixel pattern is a pixel pattern that can be formed by any one of the upper-end portion nozzle and the lower-end portion nozzle is formed by exclusively using the upper-end portion nozzle and the lower-end portion nozzle. The overlapping pixel pattern may be regarded as a pixel pattern that is formed by using nozzles, the number of which is a first number larger than a second number that is the number of nozzles used for forming the non-overlapping pixel pattern.

Operation of Print Head and Formed Dot Pattern

Figure 5:
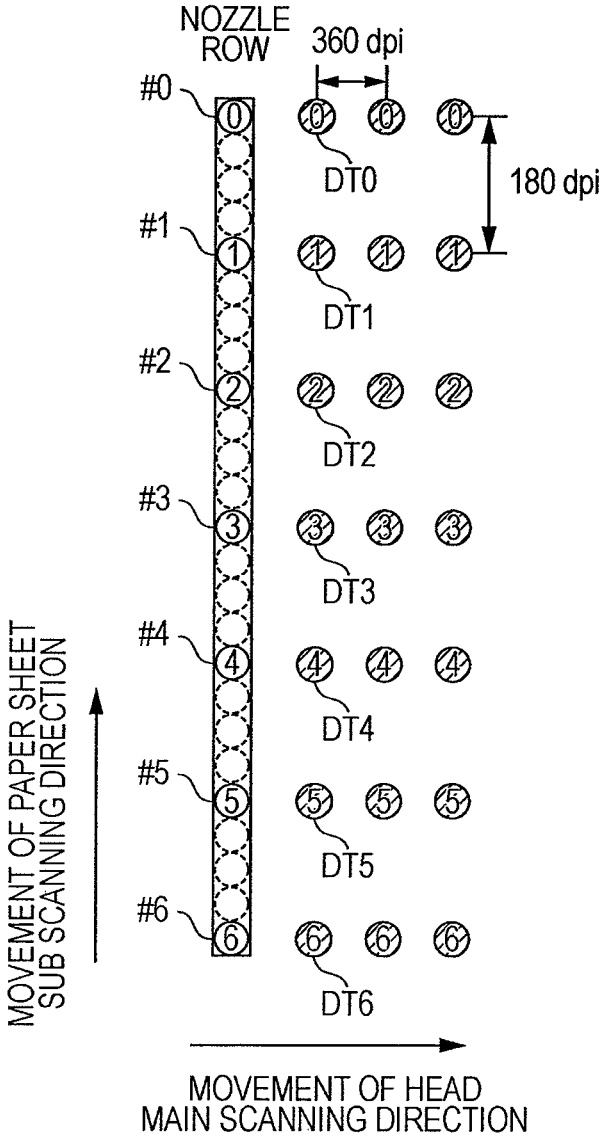
FIG. 5 is an explanatory diagram showing a dot pattern that can be formed by performing scanning once by using a print head having one nozzle row.
Figure 6:
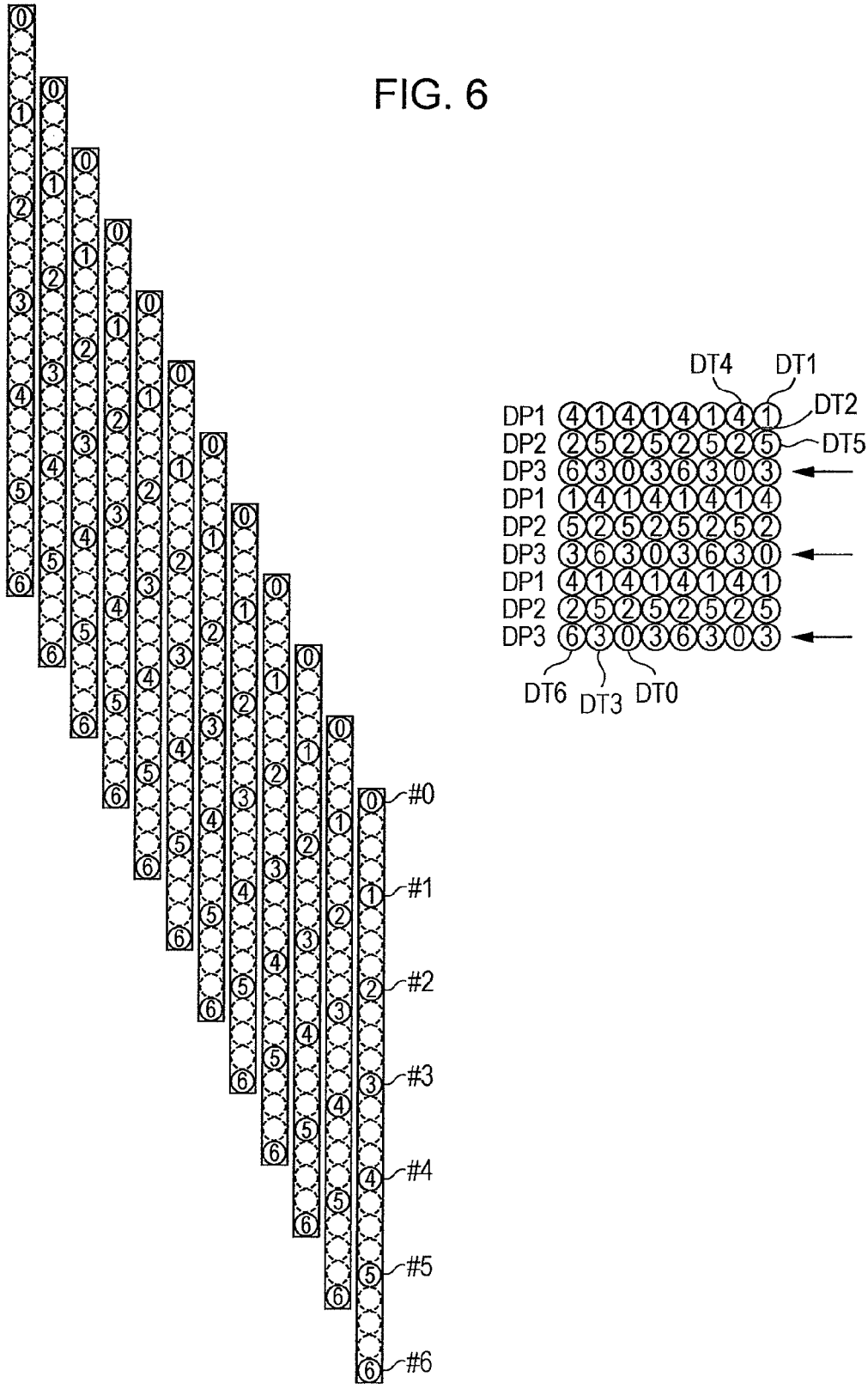
FIGS. 6A and 6B are explanatory diagrams showing the appearance of dot formation at the time of forming an image (dot pattern) of 720 dpi×720 dpi by using the print head shown in FIG. 5.

FIG. 5 is an explanatory diagram showing a dot pattern that can be formed by performing scanning once by using a print head having one nozzle row. FIGS. 6A and 6B are explanatory diagrams showing the appearance of dot formation at the time of forming an image (dot pattern) of 720 dpi×720 dpi by using the print head shown in FIG. 5. FIG. 6A shows the movement of the print head, and FIG. 6B schematically shows a formed dot pattern. The movement of the dot forming position in the sub-scanning direction is achieved by transporting a paper sheet P in the sub-scanning direction. However, for the convenience of description, the print head is described to move in the sub-scanning direction in FIGS. 6A and 6B.

In FIG. 5, a nozzle row (print head) that is constituted by seven nozzles #0 to #6 arranged at the interval of 180 dpi in the sub-scanning direction is shown. This print head can form dot patterns at the interval of 360 dpi by ejecting ink at regulated time intervals. Accordingly, when the print head shown in FIG. 5 is operated once in the main scanning direction and ink is ejected from each nozzle at the regulated time intervals, dot patterns DT0 to DT6 having the resolution of 360 dpi×180 dpi can be formed on a paper sheet.

In order to implement the resolution of 720 dpi×720 dpi by using the print head shown in FIG. 5, the relative position between the print head and the paper sheet needs to be changed twice in the main scanning direction and four times in the sub-scanning direction. In particular, by moving the print head in the main scanning direction twice, spaces between dots DT0 to DT6 in the main scanning direction, which are shown in FIG. 5, are filled. In addition, by moving the paper sheet four times in the sub-scanning direction in units of pixel rows, spaces between dots in the sub-scanning direction, which are shown in FIG. 5, for example, a space between DT0 and DT1 and a space between DT1 and DT2, are filled. In other words, the dot pattern shown in FIG. 6B is formed by shifting the paper sheet P in the sub-scanning direction in units of three pixel rows (three rows) for every main scanning operation of the print head.

Described in more detail, as shown in FIG. 6B, in this embodiment, a first dot row D1 (dot pattern) is formed in the main scanning direction by nozzles #1 and #4. In addition, a second dot row D2 (dot pattern) is formed in the main scanning direction by nozzles #2 and #5, and a third dot row D3 (dot pattern) is formed in the main scanning direction by nozzles #0, #3, and #6. The first and second dot rows D1 and D2 are dot rows that are formed by two nozzles. However, the third dot row D3 denoted by arrows are an overlapping dot row that is formed by three nozzles, the number of which is more than the number (two) of nozzles used for forming other dot rows.

The overlapping dot row, commonly, includes a dot A that is formed by the center nozzle and a dot B that is, formed by either an upper-end portion nozzle or a lower-end portion nozzle. In other words, the dot B is a dot that can be formed by any one of the upper-end portion nozzle and the lower-end portion nozzle and also is a dot that is formed by any one of the upper-end portion nozzle and the lower-end portion nozzle. In the example shown in FIG. 6B, the nozzle #3 located in the center portion corresponds to the nozzle A, and the nozzle #0 located in the upper-end portion and the nozzle #6 located in the lower-end portion correspond to nozzle B. In addition, for simplification of description, the description is made by using a single nozzle in FIGS. 6A and 6B. However, each of the nozzle A and the nozzle B may be a nozzle group that is constituted by a plurality of nozzles. In such a case, the overlapping dot row includes the dot A that is formed by a nozzle group located in the center portion and the dot B that is formed by either a nozzle group located in the upper end portion or a nozzle group located in the lower end portion. The overlapping dot row is a dot row (dot pattern) that is formed by nozzles, the number of which is the first nozzle number that is larger than the second nozzle number that is the number of nozzles that form each non-overlapping dot row. Generally, adjacent nozzles of the print head can form dot patterns by performing the same scanning operation. Accordingly, the adjacent nozzles can be appropriately adjusted so as not to generate any banding. On the other hand, the upper-end portion nozzle and the lower-end portion nozzle that are non-adjacent nozzles necessarily form dot patterns by performing different scanning operations, and accordingly, the adjustment thereof is not easy. Since banding can easily occur between a dot pattern formed by the upper-end portion nozzle and a dot pattern formed by the lower-end portion nozzle, the banding can be reduced or prevented by performing the so-called overlapping printing in which the dot pattern is formed by using both the upper-end portion nozzle and the lower-end portion nozzle.

Variation in Dot Patterns

Figure 7:
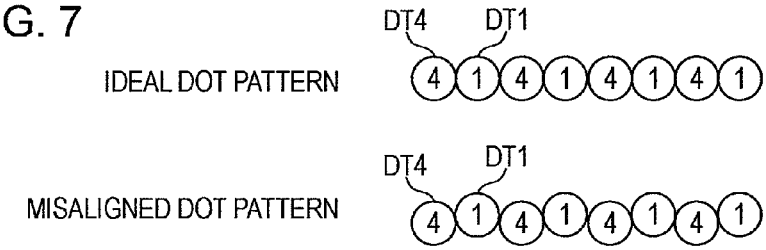
FIG. 7 is an explanatory diagram schematically showing a dot pattern in a non-overlapping dot row.
Figure 8:
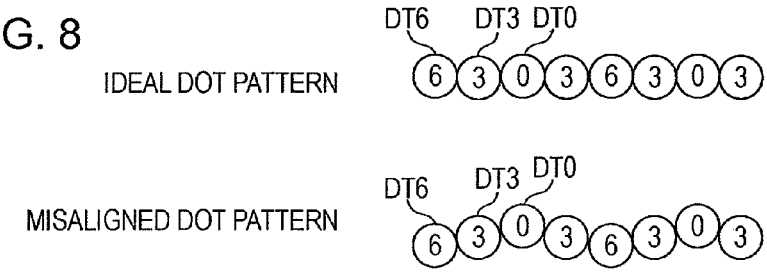
FIG. 8 is an explanatory diagram schematically showing a dot pattern in an overlapping dot row.

FIG. 7 is an explanatory diagram schematically showing a dot pattern in a non-overlapping dot row. FIG. 8 is an explanatory diagram schematically showing a dot pattern in an overlapping dot row. In addition, a number placed in the middle of a dot in each figure denotes a nozzle number, which forms the dot, in the nozzle row exemplified in FIG. 5. In the example shown in FIG. 7, the non-overlapping dot row is formed by two nozzles (#1 and #4), the number of which is the second nozzle number, as a dot row in the main scanning direction. An ideal dot pattern is a dot pattern in which there is no misalignment between the landing positions (dot positions formed by the nozzles #1 and #4) of the nozzles #1 and #4. However, practically, there is misalignment between the dot positions formed by the nozzles #1 and #4 due to a manufacturing error.

The variations in the dot positions become remarkable as the number of nozzles is increased. In the example shown in FIG. 8, an overlapping dot row is formed by three nozzles (#0, #3, and #6) corresponding to the first nozzle number in the main scanning direction. An ideal dot pattern is a dot pattern in which there is no misalignment among the landing positions (dot positions formed by the nozzles #0, #3, and #6) of the nozzles #0, #3, and #6. However, practically, there is misalignment among the dot positions formed by the nozzles #0, #3, and #6 due to a manufacturing error. In the example shown in FIG. 8, compared to a case shown in FIG. 7, the amount of misalignment between a dot formed by the nozzle #6 and a dot formed by the nozzle #0 is large.

Figure 9:
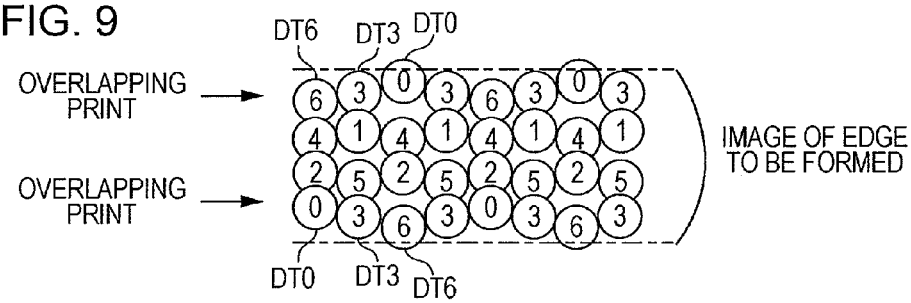
FIG. 9 is an explanatory diagram schematically showing a dot pattern corresponding to an edge that is formed in a case where the edge overlaps an overlapping dot row.
Figure 10:
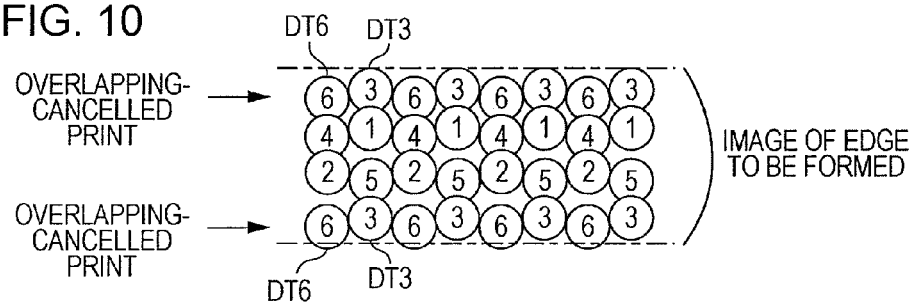
FIG. 10 is an explanatory diagram schematically showing a dot pattern corresponding to an edge formed by canceling overlapping in a case where the edge overlaps an overlapping dot row.

The amount of misalignment among the dot positions becomes visually remarkable particularly when a part of a text or a segment (edge) that extends in the main scanning direction is printed. FIG. 9 is an explanatory diagram schematically showing a dot pattern corresponding to an edge that is formed in a case where the edge overlaps an overlapping dot row. FIG. 10 is an explanatory diagram schematically showing a dot pattern corresponding to an edge formed by canceling overlapping in a case where the edge overlaps an overlapping dot row. As is apparent from comparing FIGS. 9 and 10, in a case where an overlapping dot row and an edge included in an image overlap each other, that is, in a case where a dot row of an edge portion is to be formed by an overlapping dot row, the reproducibility of the edge can be improved by canceling overlapping. By canceling overlapping, the dot pattern is formed by using nozzles, the number of which is smaller than that at the time of overlapping. Accordingly, a variation in the dots due to the manufacturing error of the nozzles is decreased, and the reproducibility of the edge is improved.

Overview of Print Control Process

Figure 11:
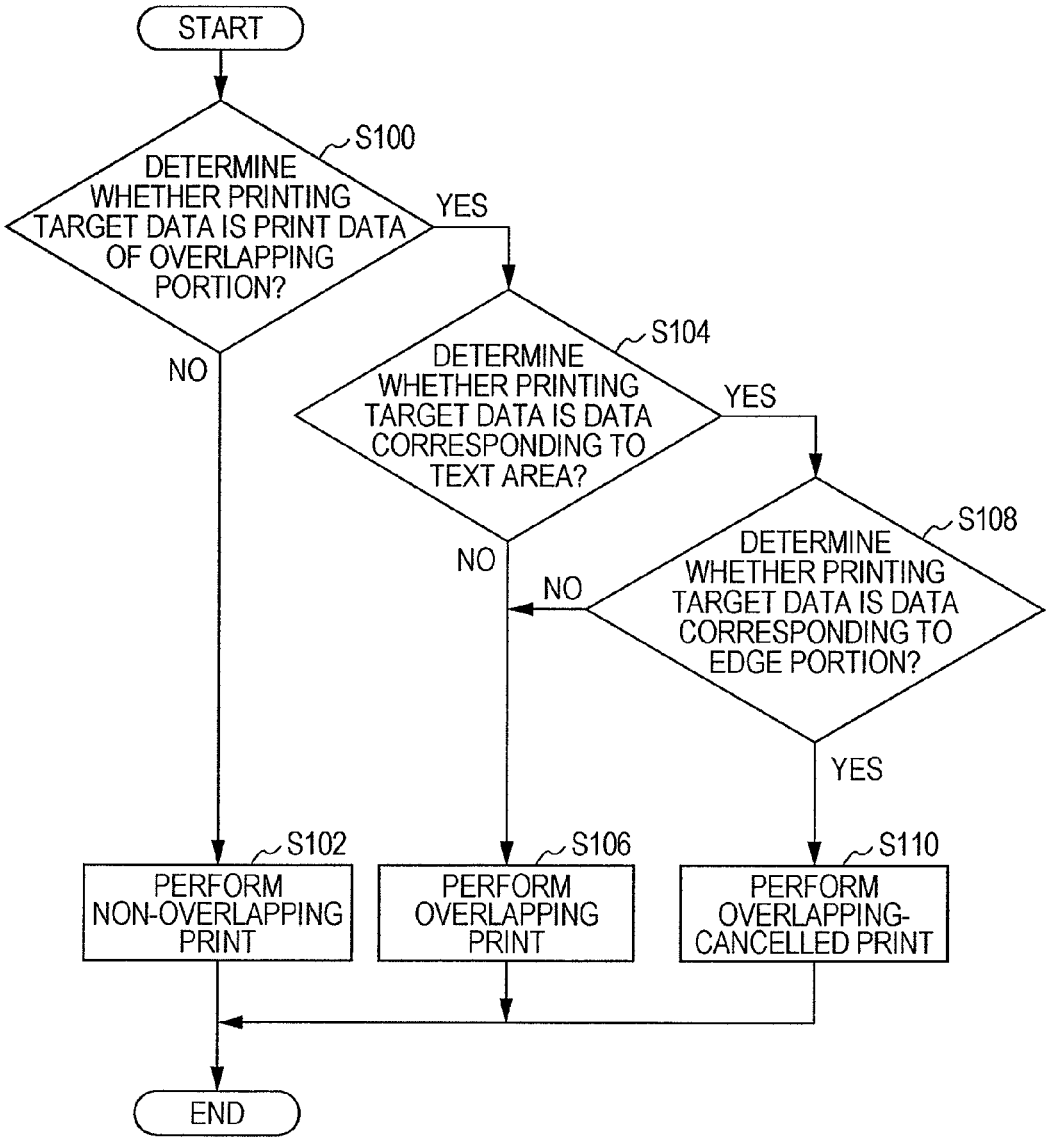
FIG. 11 is a flowchart showing an overview of a print control process according to this embodiment.

FIG. 11 is a flowchart showing an overview of a print control process according to this embodiment. The printing control device determines whether or not the printing target data is data corresponding to an overlapping dot row (Step S100). When the printing target data is determined not to be in correspondence with data corresponding to the overlapping dot row (Step S100: No), non-overlapping print is performed (Step S102). Here, the non-overlapping printing is a printing process in which the dot pattern is formed by nozzles, the number of which is the second nozzle number smaller than the first nozzle number that is the number of nozzles used for forming an overlapping dot pattern. Described in more detail, the non-overlapping printing is a printing process in which the dot pattern is formed by one or a plurality of nozzles located in the center portion of the nozzle row.

When determining that the printing target data is data corresponding to an overlapping dot row (Step S100: Yes), the printing control device determines whether or not the printing target data is data corresponding to a text area of the printing target data (Step S104). Whether or not the printing target data is data corresponding to a text area of the printing target data can be determined, for example, based on a text code included in the printing target data and the attribute information (for example, layout information that defines the position of the text) of the printing target data. Alternatively, it may be configured that the contents of the printing target data can be selected, and the contents of the printing target data are determined based on the input selection of either text data or image data. When the printing target data is an application program-specific data file, the above-described determination can be made by using a text code included in the intermediate data that is converted from the printing target data and can be analyzed by the OS and the attribute information of the intermediate data. When the printing target data is not the data corresponding to a text area of the printing target data (Step S104: No), the printing control device performs an overlapping print (Step S106). The overlapping print is a printing process in which a dot pattern is formed by at least an upper-end portion nozzle and a lower-end portion nozzle of a nozzle row that is included in the print head in the divisional manner based on the printing resolution. Described in more detail, in a case where a dot pattern can be formed by using one nozzle in a non-overlapping printing process, a dot pattern that can be formed by any one of an upper-end portion nozzle and a lower-end portion nozzle is formed by an upper-end portion nozzle and a lower-end portion nozzle (two nozzles) in a divisional manner (a dot is formed by exclusively using the upper end-portion nozzle and the lower-end portion nozzle), and accordingly, the dot pattern is formed by nozzles, the number of which is the first nozzle number larger than the second nozzle number used for the non-overlapping print.

When determining that the printing target data is data corresponding to a text area of the printing target data (Step S104: Yes), the printing control device determines whether or not the printing target data is data corresponding to an edge portion (Step S108). When determining that the printing target data is not the data corresponding to an edge portion (Step S108: No), the printing control device performs the overlapping print (Step S106). On the other hand, when determining that the printing target data is the data corresponding to an edge portion (Step S108: Yes), the printing control device performs overlapping-cancelled print (Step S110). Here, the overlapping-cancelled print is a printing process in which a dot that is formed by the upper-end portion nozzle and the lower-end portion nozzle in the divisional manner is formed by using only one of the upper-end portion nozzle and the lower-end portion nozzle. The overlapping print is a printing process that is originally performed for suppressing the occurrence of banding by dispersing the dot forming positions. Thus, when the overlapping print is performed for the edge portion, the reproducibility of the edge deteriorates as described above. Thus, when a dot, that can be formed by any one of the upper-end portion nozzle and the lower-end portion nozzle, is formed by using either the upper-end portion nozzle or the lower-end portion nozzle for the edge portion, the variation in the dot formation positions can be suppressed, and the reproducibility of the edge is improved. In addition, the reproducibility of the edge is improved for the contour (outline) of the text by additionally performing the determination of a text area, and the occurrence of banding can be suppressed by performing the overlapping print for an area inside the contour of the text, whereby blurring of a text and the like can be suppressed.

Print Control Process of Personal Computer

Figure 12:
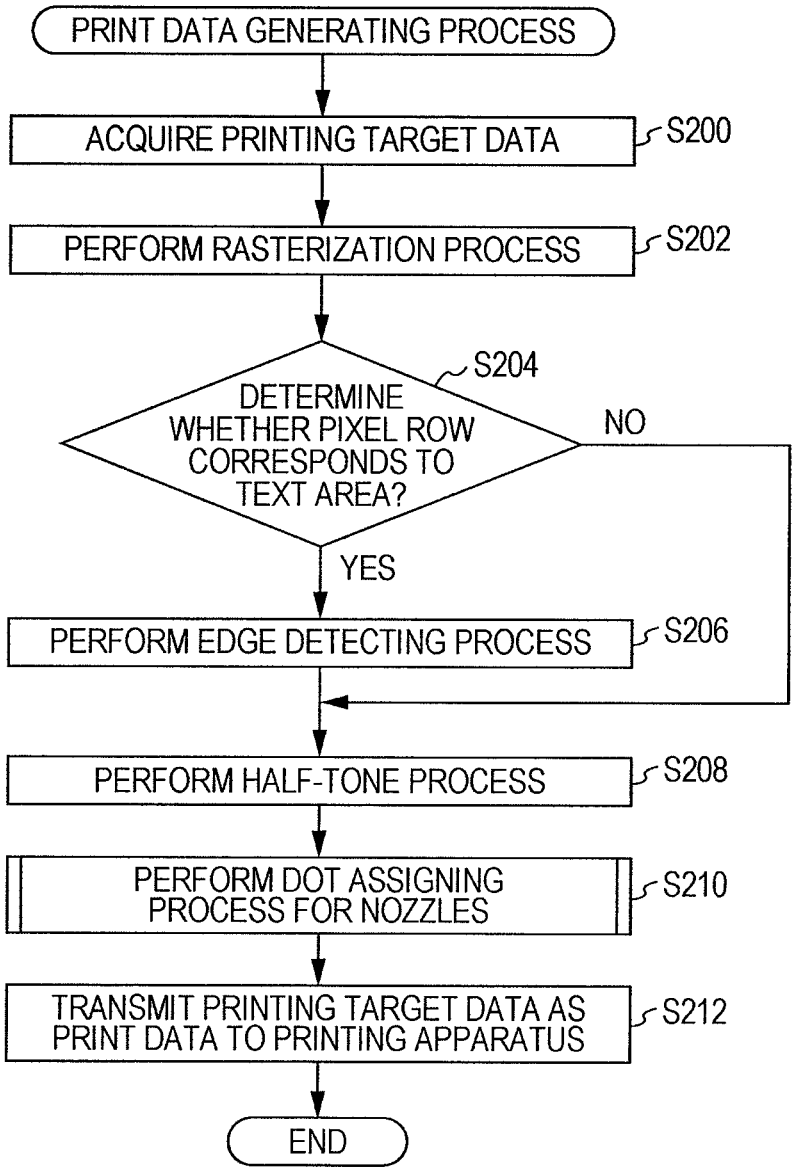
FIG. 12 is a flowchart showing the processing routine of a print control process that is performed by a personal computer according to this embodiment.
Figure 13:
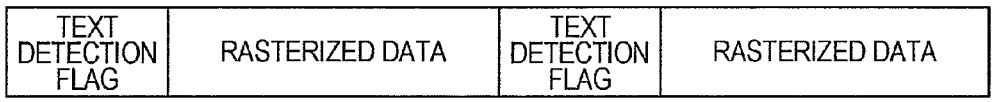
FIG. 13 is an explanatory diagram schematically showing a pixel row (rasterized data) in which a text detection flag is recorded.
Figure 14:
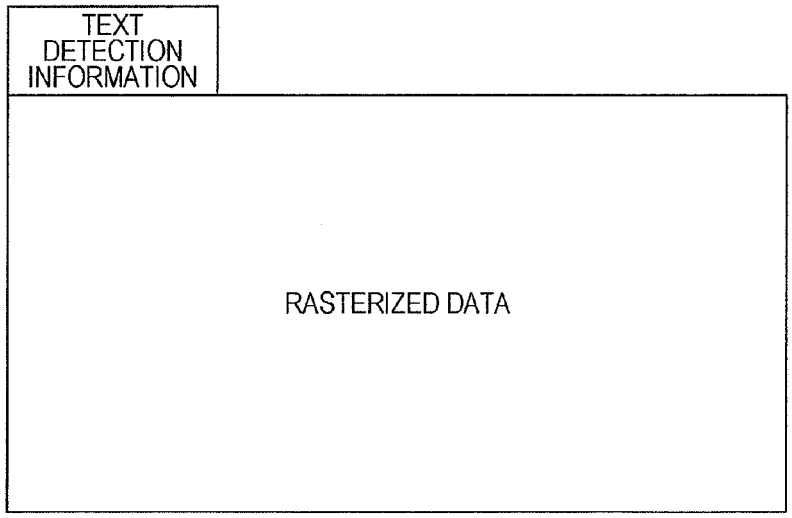
FIG. 14 is an explanatory diagram schematically showing a pixel row (rasterized data) in which text detection information is recorded.
Figure 15:
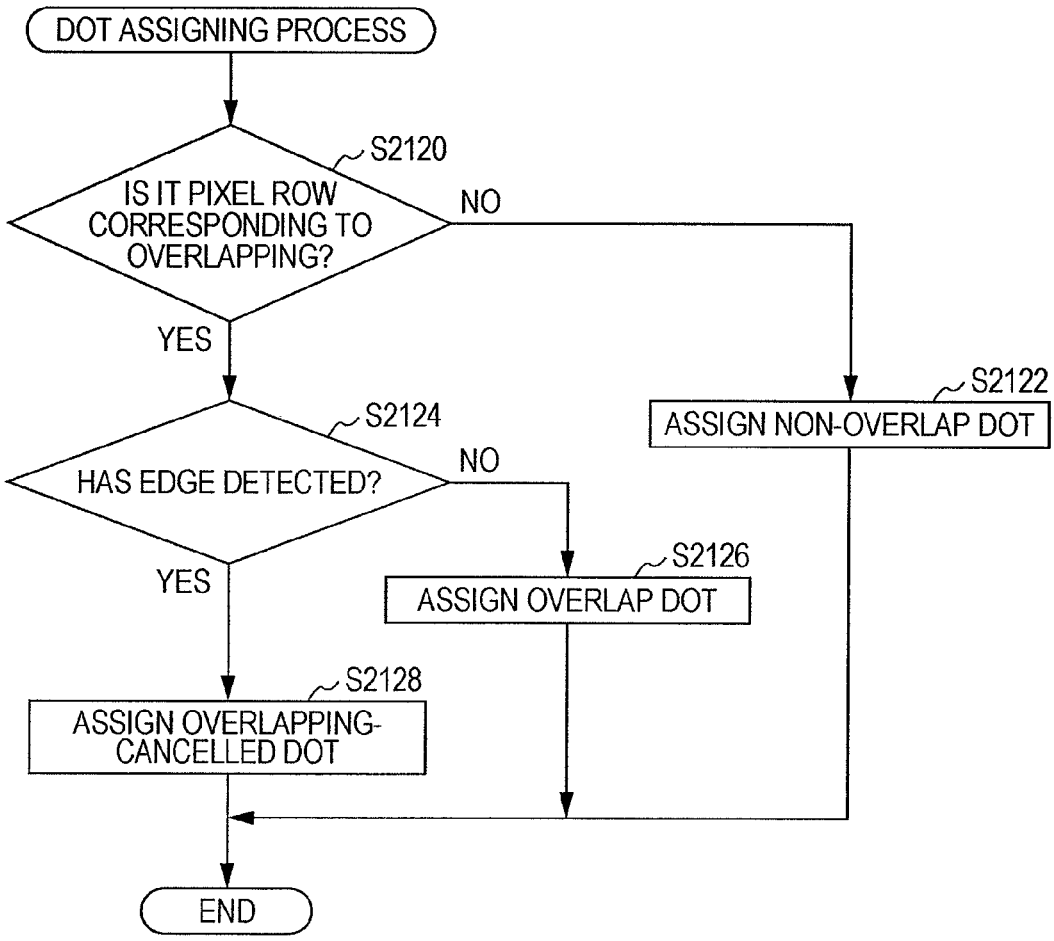
FIG. 15 is a flowchart showing the processing routine of a dot assigning process that is performed by a personal computer according to this embodiment.

FIG. 12 is a flowchart showing the processing routine of a print control process that is performed by a personal computer according to this embodiment. FIG. 13 is an explanatory diagram schematically showing a pixel row (rasterized data) in which a text detection flag is recorded. FIG. 14 is an explanatory diagram schematically showing a pixel row (rasterized data) in which text detection information is recorded. FIG. 15 is a flowchart showing the processing routine of a dot assigning process that is performed by the personal computer according to this embodiment. This processing routine, for example, is started when a print performing request is issued from an application program. The CPU 11 acquires printing target data (Step S200) and performs a color converting process as needed. Generally, the printing target data received from the application program is RGB data. Since the display color system used in the printing apparatus is the CMY system, the CPU 11 converts the RGB data into CMY data by performing an RGB-to-CMY color converting process. Then, the CPU 11 performs a rasterization process for the converted CMY data (Step S202). In the rasterization process, the CPU 11 executes the text detecting module M1 and the rasterization module M2.

The CPU 11 sequentially acquires pixel rows in units of pixel rows corresponding to the print width in the main scanning direction from the rasterized data that is acquired by the rasterization process and determines whether or not the acquired pixel row corresponds to a text area (Step S204). In particular, the CPU 11 acquires the text position of a text included in the printing target data by executing the text detecting module M1 and determines whether or not the pixel row that is sequentially acquired is made up of pixels that constitute a part of the text by executing the rasterization module M2.

When determining that the acquired pixel row corresponds to the text area (Step S204: Yes), the CPU 11, as shown in FIG. 13, records a text detection flag in the header of the acquired pixel row. Alternatively, as shown in FIG. 14, the text detection information may be recorded in the header of the acquired entire pixel rows by representing whether a pixel row includes a part of a text in the header of the acquired entire pixel rows. Then, the CPU 11 performs an edge detecting process in which whether or not an edge forming pixel is included in a pixel row, in which the text detection flag is recorded, is determined (Step S206). In other words, the CPU 11 sequentially performs the above-described edge detecting process for pixel rows in which the text detection flag is recorded by executing the edge detecting module M3. Then, the CPU 11 stores the result of the edge detection in the memory 12 in association with the pixel row from which the edge is detected. The association with the result of the edge detection may be implemented by recording an edge detection flag in the pixel row from which the edge is detected.

On the other hand, when the CPU 11 determines that the acquired pixel row does not correspond to a text area (Step S204: No), the process proceeds to Step S210. Then, the CPU 11 performs a half-tone process for the rasterized data from which the text detecting and edge detecting process has been completed (Step S208). In particular, the CPU 11 performs a gray scale value reducing process in which multiple-valued data is converted into binary data by using a technique such as a dither matrix method or an error diffusion method. In other words, dots to be formed by each nozzle of the nozzle rows included in the print head are determined.

Then, the CPU 11 performs a dot assigning process for each nozzle (Step S210). Hereinafter, a dot assigning process will be described with reference to FIG. 15. The CPU 11 sequentially acquires target pixel rows that are pixel rows to be processed in units of pixel rows corresponding to the print width in the main scanning direction from the rasterized data for which the half-tone process has been completed and determines whether or not each target pixel row corresponds to an overlapping pixel row (Step S2120). In particular, the pixel row (the position of the pixel in the sub-scanning direction), out of the pixel rows formed on the paper sheet P, corresponding to an overlapping pixel row is predetermined based on the widths of the nozzle rows of the print heads IH1 to IH4 and the printing resolution. Accordingly, it is determined whether or not the target pixel rows to be processed and the order of fetching correspond to the overlapping pixel row and the order of the overlapping pixel row that are determined in advance.

When determining that the target pixel rows do not correspond to the overlapping pixel rows (Step S2120: No), the CPU 11 assigns non-overlapping dots to the target pixel rows, and the process proceeds to Step S2130. In particular, the CPU 11 assigns dots for forming the target pixel row, that is, ON or OFF of ink ejection to nozzles, the number of which is the second number. Here, in this embodiment, as described above, the paper sheet P is transported in the sub-scanning direction in units of three pixel rows. Accordingly, one non-overlapping pixel row is formed by combining nozzles #1, #4, #2, and #5, the number of which is the second number (two), therefore ON or OFF of dot formation is assigned to nozzles #1, #4, #2, and #5.

When determining that the target pixel row corresponds to the overlapping pixel row (Step S2120: Yes), the CPU 11 determines whether or not an edge is detected from the target pixel row (Step S2124). When determining that no edge is detected from the target pixel row based on the edge flag (Step S2124: No), the CPU 11 assigns overlapping dots. In this embodiment, since the overlapping pixel row is formed by nozzles #0, #3, and #6, the number of which is the first number (three), ON or OFF of dot formation is assigned to the nozzles #0, #3, and #6. FIG. 16 is an explanatory diagram showing an example of ON (1)/OFF (0) data for dot formation that is assigned to the nozzles #0, #3, and #6 for forming an overlapping pixel row. In the example shown in FIG. 16, it is assumed that dots having dot numbers 1 to 6 are formed. As can be known from FIG. 16, dot formation is exclusively assigned to dots to be formed by the nozzles #0 and #6. As a result, the dispersibility of the dots becomes high, and the banding can be suppressed.

On the other hand, when determining that an edge is detected from the target pixel row (Step S2124: Yes), the CPU 11 assigns overlapping-cancelled dots. FIG. 17 is an explanatory diagram showing an example of ON (1)/OFF (0) data for dot formation that is assigned to the nozzles #0, #3, and #6 for canceling overlapping for the overlapping pixel row. Also in the example shown in FIG. 17, it is assumed that dots having dot numbers 1 to 6 are formed. When overlapping is not cancelled, the dot assigning shown in FIG. 15 is performed. As can be known from FIG. 17, for dots to be formed by the nozzles #0 and #6, dot formation is assigned only to the nozzle #6. As a result, the pixel row that is originally to be formed as an overlapping pixel row is formed by nozzles, the number of which is the second number (two), similarly to the non-overlapping pixel row. Accordingly, the dispersibility of the dots becomes low, and the reproducibility of the edge can be improved. In selecting a nozzle, it is preferable that one nozzle out of the upper-end portion nozzle #0 and the lower-end portion nozzle #6 having the characteristics of dot formation (ink ejecting characteristics) that are closer to those of the center-portion nozzle #3 is selected. In such a case, since the characteristics of dot formation of two nozzles that form the overlapping pixel row are very similar to each other, the reproducibility of the edge can be improved further. The characteristics of nozzles are stored in the memory 12 when the print control program is installed to the personal computer 10.

The CPU 11 repeatedly performs the process of Steps S2120 to S2128 until dot assigning to all the target pixel rows is completed so as to generate print data that includes rasterization control data for controlling ON/OFF of dot formation by using the print head IH1 to IH4, and this processing routine ends. In addition, in the print data, control data that represents the main scanning speeds of the print heads IH1 to IH4, the amount of transport of the paper sheet P, and transport time other than the rasterization control data for controlling ON/OFF of dot formation are included.

As described above, according to the printing control device of this embodiment, that is, the personal computer 10, overlapping print is cancelled in a case where an edge forming pixel (edge component) is included in a pixel row corresponding to the overlapping pixel row, whereby the reproducibility of the edge can be improved. In other words, in the overlapping pixel row that is formed by using nozzles, the number of which is the first number, compared to a case where nozzles, the number of which is the second number smaller than the first number are used, the pixel forming positions are dispersed (the nozzle-specific regularity is relieved), and accordingly, occurrence of banding can be suppressed. However, there are cases where an edge for which the pixels must not be dispersed cannot be precisely reproduced. Thus, when the pixel row corresponding to the overlapping pixel row includes an edge forming pixel, dot forming is performed by using nozzles, the number of which is the second number by canceling overlapping. Accordingly, the dispersion of dots is suppressed, the unsteady variation in the edges is suppressed, and the reproducibility of the edge can be improved.

In this embodiment, the edge determining process is performed only for the target pixel row that includes a text component (a pixel that constitutes a part of a text), and accordingly, the time required for the edge detecting process can be shortened. As a result, both the suppression of an increase in the print processing time and improvement of the reproducibility of the edge can be achieved. In addition, by performing the edge detecting process, the overlapping print is cancelled only for forming the pixels that constitute the contour (outline) of the context. Accordingly, the dot pattern is formed by overlapping print for the text area other than the contour, and blurring of texts accompanied by banding and the like can be suppressed or prevented.

In addition, according to this embodiment, the overlapping pixel row is formed in the main scanning direction, and particularly, the reproducibility of the edge to be formed in the main scanning direction can be improved. On the other hand, for the edge to be formed in the sub-scanning direction, the unsteadiness and the variation in the edges due to overlapping print are not remarkable in the main scanning direction. Accordingly, when the edge detecting process is performed, the edge detecting for the main scanning direction may be performed first.

Second Embodiment

Figure 18:
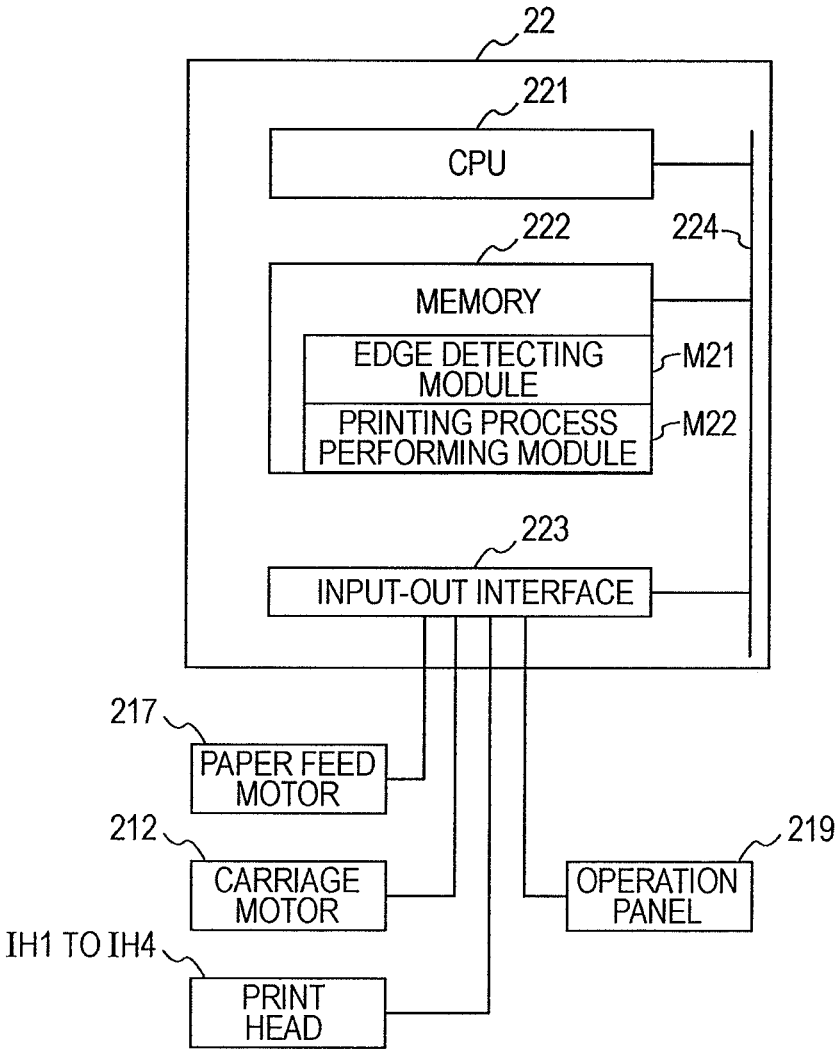
FIG. 18 is a block diagram showing the internal functional configuration of a printing apparatus according to a second embodiment of the invention.
Figure 19:
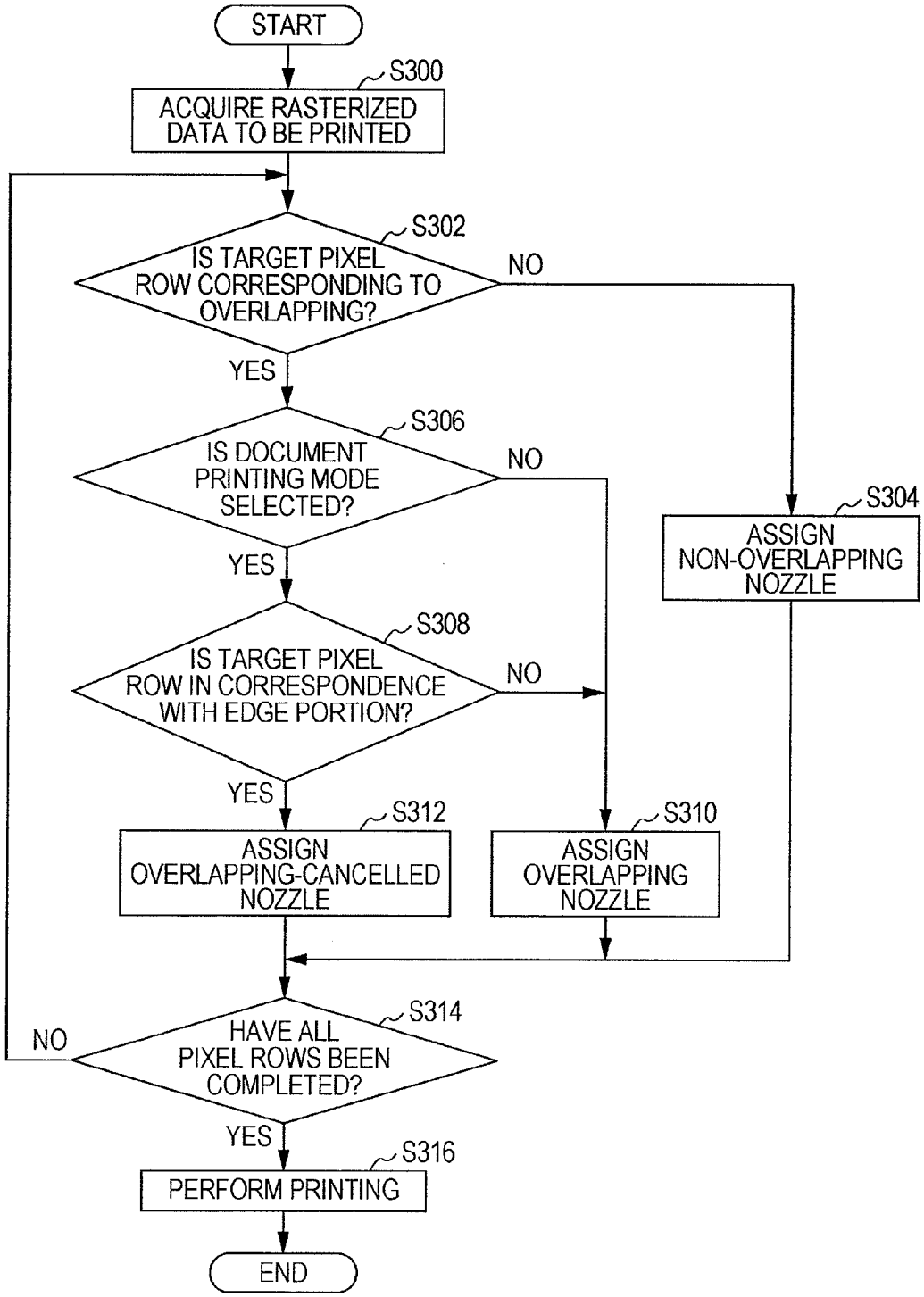
FIG. 19 is a flowchart showing the process routine of a printing process that is performed by a printing apparatus according to the second embodiment.

In the first embodiment, a case where the personal computer 10 serves as a printing control device, that is, a case where the printing apparatus 20 performs a printing process based on the print data received from the personal computer 10 has been described. In a second embodiment of the invention, the above-described various processes are performed in the printing apparatus 20. FIG. 18 is a block diagram showing the internal functional configuration of a printing apparatus according to the second embodiment. In addition, FIG. 19 is a flowchart showing the process routine of a printing process that is performed by the printing apparatus according to the second embodiment. Since the basic configuration of the printing apparatus 20 is the same as that of the above-described first embodiment, hereinafter, the internal configuration of a control circuit 22 will be described.

The control circuit 22 of the printing apparatus 20 includes a central processing unit (CPU) 221, a memory 222, an input-output interface 223, and an internal bus 224. The CPU 221 implements various function units by executing various programs that are stored in the memory 222. The memory 222 is implemented by using a read only memory (ROM), a random access memory (RAM), and a hard disk drive (HDD). In this embodiment, the term "memory 222" is used for collectively referring to a non-volatile memory device in which the above-described various programs are stored and a volatile memory device that is used for executing various programs.

The memory 222 includes a rasterization module M21, and an edge detecting module M22, and a print process performing module M23 for performing a print performing process. By performing these modules M21 to M23 by using the CPU 221, an edge detecting unit, and a print performing unit are realized. In this embodiment, the above-described modules are implemented in software. However, the above-described modules may be implemented in hardware devices that include logic circuits corresponding thereto.

The rasterization module M21 expands target data in the memory as image data, that is, rasterized data. Generally, in a case where the target data is directly input to the printing apparatus 20, the target data is originally the rasterized (image) data frequently. Thus, the rasterization module M21 expands the input image data in the memory 222. Each dot (pixel) that is formed by rasterization is managed as rasterized data for each unit corresponding to a dot pattern (one row to be formed in the main scanning direction) to be formed in the main scanning direction. In addition, according to this embodiment, either a document printing mode in which the target data is printed as data including a text or an image printing mode in which the target data is printed as image data that is to be used for a printing process is input by a user through an operation panel 219.

The edge detecting module M22 detects an edge included in the rasterized printing target data in a case where the document printing mode is selected by the user through the operation panel 219.

In this embodiment, a pixel having the K component value of 100% (for example, a pixel having the K component value of "255" for the case of 8 bit gray scale) is determined to be an edge forming pixel by using the image data that has been converted in color from RGB data into CMYK data by the print process performing module M23 to be described later. The threshold values used for detecting an edge may be a different value "250" or "230". Alternatively, for example, in a case where a difference value between the K components of adjacent pixels is equal to or larger than a determination value 250 or 220, a pixel having a larger K component value may be determined to be an edge forming pixel. In such a case, only pixels that form contour portions of a text can be determined as the edge forming pixels. In addition, the K component value may be configured to be 100% for the case of "255" or be 100% for the case of "0".

The print process performing module M23 generates rasterization control data that is used for forming a dot pattern corresponding to the printing target data by performing a half-tone process for the CMYK data that has been converted in color from RGB data rasterized by the rasterization module M21. In particular, the print process performing module M23 converts the CMYK data that is multiple-valued data into binary rasterization control data represented in binary values by using a dither matrix or an error diffusion method. The acquired rasterization control data is data that is associated with each of a plurality of nozzles included in the nozzle row arranged for ink of each color of CMYK and controls ON/OFF of ink ejection. In other words, by driving each nozzle of the print head based on the rasterization control data, a dot pattern representing an image that is represented by the printing target data is formed on a paper sheet used as a medium.

The input-output interface 223 is a physical and software port that interconnects a paper transport motor 217, a carriage motor 212, print heads IH1 to IH4, an operation panel 219, and a control circuit 22.

The internal bus 14 interconnects the CPU 11, the memory 12, and the input-out interface 13 for two-way communication.

The print performing process that is performed by the printing apparatus 20 according to this embodiment will be described with reference to FIG. 19. The CPU 221 acquires the printing target data and performs a rasterization process for the acquired printing target data (Step S300). The rasterization process, as described above, is performed by the rasterization module M21.

The CPU 221 extracts data for each print range of the print heads IH1 to IH4 in the main scanning direction from the rasterization data, which has been acquired by the rasterization process, as a target pixel row and determines whether the pixel row corresponds to an overlapping pixel row (Step S302). Since a detailed determining technique for the overlapping pixel row has been described in the first embodiment, a description thereof is omitted here.

When determining the target pixel row not to correspond to an overlapping pixel row (Step S302: No), the CPU 221 associates a flag of non-overlapping nozzle assignment with the target pixel row (Step S304), and the process proceeds to Step S314. On the other hand, when determining the target pixel row to correspond to an overlapping pixel row (Step S302: Yes), the CPU 221 determines whether the document printing mode is selected (Step S306). In other words, the CPU 211 determines whether an input for selecting the document printing mode is made through the operation panel 219.

When determining that the document printing mode is not selected (Step S306: No), the CPU 221 associates a flag of overlapping nozzle assignment with the target pixel row (Step S310), and the process proceeds to Step S314. On the other hand, when determining that the document printing mode is selected (Step S306: Yes), the CPU 221 determines whether the target pixel row corresponds to an edge portion (Step S310).

When the CPU 221 determines that the target pixel row does not correspond to the edge portion (Step S310: No), the process proceeds to Step S308. On the other hand, when determining that the target pixel row corresponds to an edge portion (Step S310: Yes), the CPU 221 associates a flag of overlapping-cancelled nozzle assignment with the target pixel row (Step S312).

The CPU 221 performs the Steps S302 to S312 for all the pixel rows that are included in the rasterized data (Step S314: No). When the above-described steps are performed for all the pixel rows (Step S314: Yes), the printing process is performed (S316). In particular, the CPU 221 performs a half-tone process for the rasterized data and assigns rasterization control data to each nozzle of the print heads IH1 to IH4 in accordance with the flag associated with each pixel row. When the overlapping-cancelled nozzle is assigned, the CPU 221 selects a nozzle, which has the characteristics closest to those of the center-portion nozzle, out of the upper-end portion nozzles and the lower-end portion nozzles based on the characteristics of the nozzles stored in the memory 222 in advance. The CPU 221 forms a dot pattern corresponding to the target image data on the paper sheet P by controlling the paper transport motor 217, the carriage motor 212 and the print heads IH1 to IH4.

According to the printing apparatus 20 of the second embodiment, it is determined whether a text is included in the target data, in other words, whether the edge detecting process is performed based on the set printing mode. Accordingly, the reproducibility of the edge can be improved without disposing a module for text detecting process.

In addition, according to the printing apparatus 20 of the second embodiment, the reproducibility of the edge can be improved also for a text, a ruled line, and the like that are included in the target data directly input to the printing apparatus 20.

According to the printing apparatus 20 of the second embodiment, similarly to the personal computer 10 (printing control device) of the first embodiment, the reproducibility of the edge can be improved.

Other Embodiments

Figure 20:
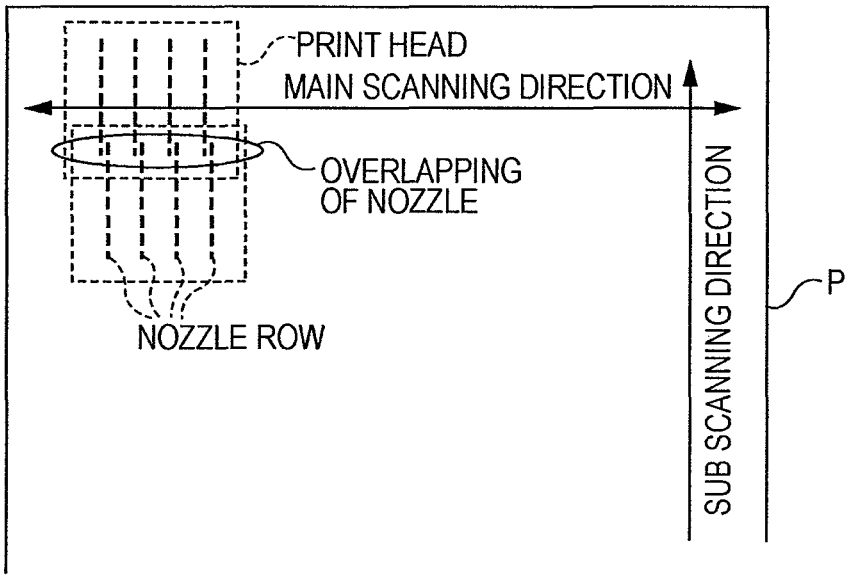
FIG. 20 is an explanatory diagram schematically showing a print method for forming a dot pattern on a paper sheet by arranging a plurality of print heads in the main scanning direction and moving the paper sheet in the sub-scanning direction.

FIG. 20 is an explanatory diagram schematically showing a print method for forming a dot pattern on a paper sheet P by moving the print heads IH1 to IH4 in the main scanning direction and moving the paper sheet P in the sub-scanning direction. In each of the above-described embodiments, an example in which the paper sheet P is transported in units of three pixels in the sub-scanning direction has been described. However, the invention can be applied to so-called printing in units of bands in which a printing process corresponding to the nozzle width of the print heads IH1 to IH4 is performed by scanning once. For example, as shown in FIG. 20, in a case where the paper sheet P is transported in units of seven pixels in the sub-scanning direction, an overlapping pixel row can be foamed by transporting the paper sheet P in units of six pixels in the sub-scanning direction. In such a case, an overlapping pixel row is formed by using two nozzles, that is, the upper-end nozzle and the lower-end nozzle, and a non-overlapping pixel row is formed by one nozzle, that is, each of nozzles other than the upper-end nozzle and the lower-end nozzle. This aspect, for example, is used in a case where the printing resolution and the resolution that is acquired by ejecting all the dots that are formed by scanning once by using the print heads IH1 to IH4 are the same.

Figure 21:
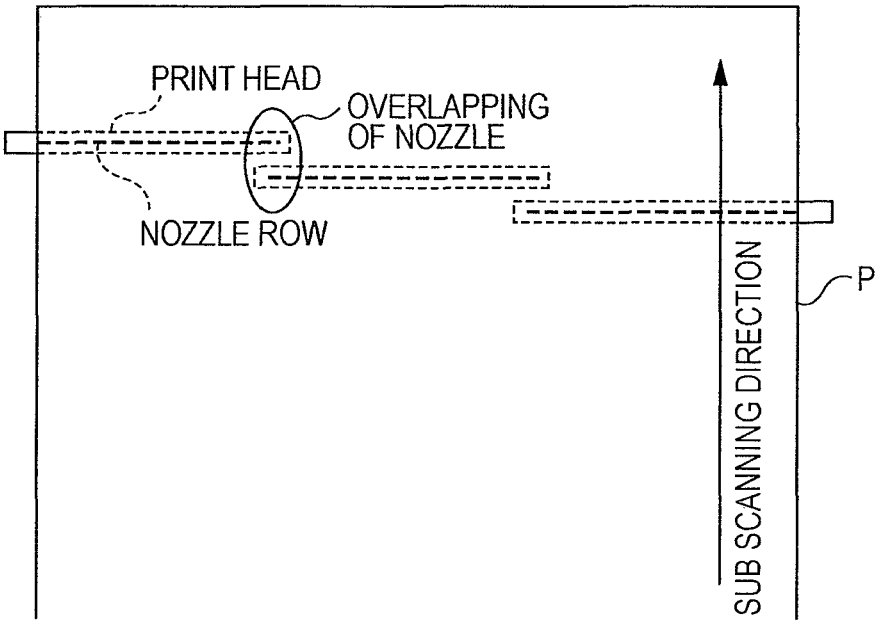
FIG. 21 is an explanatory diagram schematically showing a print method for forming a dot pattern on a paper sheet by arranging a plurality of print heads in the main scanning direction and moving the paper sheet in the sub-scanning direction.

FIG. 21 is an explanatory diagram schematically showing a print method for forming a dot pattern on a paper sheet P by arranging a plurality of print heads in the main scanning direction and moving the paper sheet P in the sub-scanning direction. In each of the above-described embodiments, a printing process performed in the main scanning direction is implemented by moving the print heads IH1 to IH4 in the main scanning direction. However, the invention can be applied to a line-type printing method in which the print heads are arranged in the main scanning direction with a part of the nozzles disposed so as to be overlapped with each other and only the paper sheet P is moved in the sub-scanning direction. Also in such a case, an overlapping pixel row is formed by using nozzles that are overlapped with each other among the print heads. Accordingly, the reproducibility of the edge can be improved by controlling dot ejection such that an overlapping pixel row is not formed in an edge portion. In addition, since the overlapping pixel row is formed in the sub-scanning direction in the example shown in FIG. 21, particularly the reproducibility of the edge that is formed in the sub-scanning direction can be improved.

In the first embodiment, all of the text detecting process, the edge detecting process, the rasterization process, the half-tone process, and the dot assigning process are performed by the personal computer 10 serving as a printing control device, and the print data including the rasterization control data is transmitted to the printing apparatus 20. However, it may be configured that the text detecting process, the edge detecting process, the rasterization process, and the half-tone process are performed by the personal computer 10, and the dot assigning process is performed by the printing apparatus 20. In such a case, the print data that is transmitted from the personal computer 10 to the printing apparatus 20 is associated with a flag for specifying the edge pixel row that is used for specifying the pixel row including the edge forming pixel. Alternatively, it may be configured that the text detecting process is performed by the personal computer 10, and the edge detecting process, the rasterization process, the half-tone process, and the dot assigning process are performed by the printing apparatus 20. In such a case the load of the personal computer for the printing process can be reduced.

In the above-described embodiments, a dot pattern having the resolution of 360 dpi for the main scanning direction and 180 dpi for the sub-scanning direction can be formed by performing the scanning operation once. However, in a case where ink ejection can be performed at a higher speed by the print head IH, for example, a dot pattern can be formed with the resolution of 720 dpi or 1440 dpi for the main scanning direction by performing the scanning operation once.

In the above-described embodiments, the example of the printing control device and the printing apparatus has been described. However, it is apparent that the invention may be implemented as a print control processing program performed by a printing control device, a computer-readable medium (for example, a CD, a DVD, or an HDD) storing a print control processing program stored thereon, or a printing control method.

In the above-described embodiment, edge detection (edge determination) is performed only based on the K component. However, the edge detection may be performed for each component of CMY. For example, it is preferable to perform the edge detection based on the C component in a case where the text color is represented by the C component. In addition, the edge detection may be performed based on a difference between each of the component values (gray scale values) of CMYK and each of the component values (gray scale values) of CMYK, for which the unsteady variation in the edges is prepared in advance as a visually distinguished pattern, for each of the components of CMYK. For example, since the unsteady variation in the edge in the Y component cannot be easily distinguished relatively, the load for the edge detection in forming dots by using a plurality of colors can be reduced by not performing the edge detection for a pixel of which the Y component has a large value.

In the above-described embodiments, the edge detection is performed based on the CMYK data of a display color system that is the display color system of an image output on the paper sheet P. However, the edge detection may be performed based on the RGB data. For example, it may be configured that combination patterns of the component values of CMYK data and combination patterns of the component values of the RGB data are prepared in advance, and the combination pattern of the components of the CMYK data that forms an edge is detected. In addition, in a case where RGB data is used, the edge detection may be performed by using luminance values after the RGB data is converted into the luminance values.

In the above-described embodiments, the edge of a text has been described. However, similarly, the reproducibility of the edge can be improved for the edge of line drawing and underline other than the text. For example, in the second embodiment, the description has been made only for the document mode. However, a graphic mode other than the document mode may be selected.

In the above-described embodiment, reduction in the variation in the edges arranged in the main scanning direction has been described. However, the overlapping print may be canceled in consideration of the variation in the edges arranged in the sub-scanning direction. However, since the dot pattern arranged in the sub-scanning direction is formed by using almost all or all of the plurality of nozzles that is included in the nozzle row, the advantage acquired by canceling the overlapping print is not that high. Accordingly, even in a case where the variation in the edges arranged in the sub-scanning direction is considered, it is preferable that the overlapping print is canceled having priority on the reduction in the variation in the edges arranged in the main scanning direction. In addition, cancellation of the overlapping print for the edge arranged in the sub-scanning direction may be determined for each printing apparatus by reflecting the individual differences of the nozzles.

As above, the embodiments and the modified examples of the invention have been described. However, the above-described embodiments of the invention are not for the purpose of limiting the invention but for easy understanding of the invention. The invention can be changed or modified without departing from the intention thereof and the scope of claims. Furthermore, equivalents of the invention belong to the scope of the invention.

The entire disclosure of Japanese Patent Application No. 2008-296023, filed Nov. 19, 2008 is expressly incorporated by reference herein.

What is claimed is:

1. A printing apparatus comprising:

a print head that includes a plurality of nozzles including lower-end portion nozzles, center-portion nozzles, and upper-end portion nozzles;

a medium transport unit that transports a medium that becomes a printing target;

an edge detecting unit that detects an image boundary edge included in image data; and a print control unit that forms a row of dots on the medium by driving the print head together with relatively moving the print head and the medium, the row of dots being formed on the medium by using at least two different nozzles of the plurality of nozzles, wherein the number of different nozzles used is a first number in a case where the row of dots does not correspond to an image boundary edge detected by the edge detecting unit and the row of dots can be formed at least in part by one of the upper-end portion nozzles and one of the lower-end portion nozzles, and wherein the number of different nozzles used is a second number that is smaller than the first number where the row of dots corresponds to an image boundary edge detected by the edge detecting unit and the row of dots can be formed at least in part by one of the upper-end portion nozzles and one of the lower-end portion nozzles.

2. The printing apparatus according to claim 1, wherein the number of different nozzles used is the second number where the row of dots cannot be formed at least in part by one of the upper-end portion nozzles and one of the lower-end portion nozzles.

3. The printing apparatus according to claim 1, wherein the row of dots is formed on the medium in a first scanning direction by relatively moving the print head and the medium in the first scanning direction and a second scanning direction that is perpendicular to the first scanning direction.

4. The printing apparatus according to claim 3, wherein the row of dots is formed on the medium by moving the print head in the first scanning direction and moving the medium in the second scanning direction.

5. The printing apparatus according to claim 1, wherein the the image boundary edge detecting process is performed in a case where the image data includes at least one of a document or a line drawing.

6. The printing apparatus according to claim 5, further comprising:

a text detecting unit that detects whether or not a text is included in target data; and an image converting unit that converts the target data into the image data, wherein the edge detecting unit performs the image boundary edge detecting process in a case where the image data is determined to include a text by the text detecting unit.

7. The printing apparatus according to claim 3, wherein the print control unit forms the row of dots on the medium in the first scanning direction by using either one of the lower-end portion nozzles or one of the upper-end portion nozzle nozzles that has characteristics closer to those of one of the center-portion nozzles in a case where the image boundary edge is detected by the edge detecting unit.

8. The printing apparatus according to claim 1, wherein the print control unit forms the row of dots on the medium by moving the medium such that a row of dots that can be formed by one of the upper-end portion nozzles and a row of dots that can be formed by one of the lower-end portion nozzles are overlapped with each other and moves the medium such that the row of dots that can be formed by the one of the upper-end portion nozzles and the pixel pattern row of dots that can be formed by the one of the lower-end portion nozzle nozzles are not overlapped with each other in a case where the image boundary edge is detected by the edge detecting unit.

9. The printing apparatus according to claim 8, wherein the print control unit moves the medium such that the row of dots that can be formed by the one of the upper-end portion nozzles and the row of dots that can be formed by the one of the lower-end portion nozzles are overlapped with each other in a case where the image boundary edge is not detected by the edge detecting unit and moves the medium such that the row of dots that can be formed by the one of the upper-end portion nozzles and the row of dots that can be formed by the one of the lower-end portion nozzles are not overlapped with each other in a case where the image boundary edge is detected by the edge detecting unit.

10. The printing apparatus according to claim 1, wherein the medium transport unit transports the medium in a transport direction, wherein the print head moves in a direction perpendicular to the transport direction, wherein the edge detecting unit performs the image boundary edge detecting process in a case where the image data includes a document or line drawing, and wherein the number of different nozzles used of the plurality of nozzles is the second number when the row of dots cannot be formed at least in part by one of the upper-end portion nozzles and at least one of the lower-end portion nozzles.

11. A printing method using a printing apparatus that has a print head that includes a plurality of nozzles including lower-end portion nozzles, center-portion nozzles, and upper-end portion nozzles, the printing method comprising:

detecting an image boundary edge that is included in image data; and forming a row of dots on a medium by using at least two different nozzles out of the plurality of nozzles, wherein the number of different nozzles used is a first number in a case where any an image boundary edge is not detected from the image data and the row of dots can be formed at least in part by one of the upper-end portion nozzles and one of the lower-end portion nozzles, and wherein the number of different nozzles used is a second number smaller than the first number in a case where an image boundary edge is detected from the image data and the row of dots can be formed at least in part by one of the upper-end portion nozzles and one of the lower-end portion nozzles.

12. The printing apparatus according to claim 1, further comprising a processor, wherein:

the edge detecting unit includes instructions executable by the processor to detect image boundary edges included in the image data; and the print control unit includes instructions executable by the processor to form the row of dots on the medium.

13. The printing apparatus according to claim 12, wherein the image data comprises rasterized image data.

14. The printing method according to claim 11, wherein the image data comprises rasterized image data.

* * * * *